United States Patent [19]

Guyonnet

[11] 4,204,382

[45] May 27, 1980

[54] APPARATUS FOR PACKAGING PASTY MATERIAL

[76] Inventor: Marcel A. R. Guyonnet, 25, rue Anatole France, Chaville (Hauts-de-Sein), France

[21] Appl. No.: 948,573

[22] Filed: Oct. 4, 1978

Related U.S. Application Data

[63] Continuation of Ser. No. 376,680, Jul. 5, 1973, abandoned, which is a continuation of Ser. No. 94318, Dec. 2, 1970, abandoned.

[30] Foreign Application Priority Data

Dec. 4, 1969 [FR] France ..... 69 41904

[51] Int. Cl.[2] ..... B65B 43/08; B65B 47/00

[52] U.S. Cl. ..... 53/563; 53/282

[58] Field of Search ..... 53/412, 433, 449, 558, 53/456, 563, 281, 282, 511, 559, 453

[56] References Cited

U.S. PATENT DOCUMENTS

| | | | |
|---|---|---|---|
| 2,649,671 | 8/1953 | Bartelt | 53/433 |
| 3,503,182 | 3/1970 | Phipps | 53/282 |
| 3,513,618 | 5/1970 | Woodruff et al. | 53/449 |
| 3,577,700 | 5/1971 | Bippus et al. | 53/184 X |
| 3,628,303 | 12/1971 | Graham | 53/453 |

FOREIGN PATENT DOCUMENTS

| | | | |
|---|---|---|---|
| 1417658 | 10/1965 | France | 53/282 |

*Primary Examiner*—Horace M. Culver

[57] ABSTRACT

A machine for performing the various successive operations required for packaging a pasty material in individually wrapped portions, and more particularly melted cheese, in the form of portions, having a series of work positions equal in number to the number of operations. The work positions each have a plurality of identical working tools which are arranged transverse to the movement of the pasty material and the wrapping material. The work positions and their tools as a whole, constitute a plurality of parallel work-lines having successive stations all capable of simultaneous operation to provide sequential operation on pasty material and wrapping.

12 Claims, 6 Drawing Figures

2i
18
2j
27j
19
28j
14
13
16.
28i
17
27i
3
11
27g
28g
27h
28h
2h
10
2g
27f
2f
28f
1.
2e
27e
28e
9
2d
27d
28d
29.
2c
27c
8
28c
2b
28b
27b
7
4
2a
6
5
36.
37.
28.
12.
15
29.

2p.
2q.
12.
15
16.
17
18
19
20
13
14
1.
2i
2j
2l
2m
2n
2o
21
22
23
24
25
26
27i
27j
27k
27l
27m
28i
28j
28k
28l
30
31h
31j
31k
31l
32
33
34
35
36.
37.
38

172
173
13
15b
14
181
152
170
157
150
156
158
159
151
167
166
160
161
162
163
164
165
165a
168
154
169
171
155
153
13
150
181
14
181
15b
15a
15
13
15
2a
27b
152
150
35a
33
33
35
34

APPARATUS FOR PACKAGING PASTY MATERIAL

This is a continuation of Ser. No. 376,680 filed July 5, 1973; now abandoned which itself is a continuation of Ser. No. 94,318 filed Dec. 2, 1970 now abandoned.

BACKGROUND OF INVENTION

The present invention relates to the packaging of a material, and more particularly melted cheese, in the form of portions by means of a machine which enables the various successive packaging operations to be performed and which accordingly has a corresponding number of serially arranged workpositions, said machine being capable of operating at a basic rate chosen between determinate minimum and maximum rates.

Among other things the invention aims at meeting the possible need for higher production outputs without altering the basic rate while at the same time substantially reducing production costs.

SUMMARY OF INVENTION

The invention accordingly provides a packaging machine of the kind referred to, wherein the work-positions are arranged in line and each have the same number of identical working tools which in respect to the work positions as a whole constitute a plurality of parallel work-lines.

The machine has a conveyor to which a substantially endless thin flexible film is fed. A plurality of work stations each having a plurality of identical tools which perform a single operation on said film is arranged in cooperation with the conveyor. The tools of each station are lingitudinally aligned with those of the other stations to provide a plurality of parallel processing lines. The work stations are divided into at least two groups arranged along the conveyor means; the first group functioning to successively cut and shape the film into individual flexible shells, and a second group functioning to fill the flexible shells and close the shells to form the packages. The second group contain means for supporting the flexible shells during filling and closing, for carrying the shells in their supports between work-stations, and means for synchromously driving said conveyor means in stepwise fashion through the successive work-stations.

In the preferred form of the machine the tools at each of the work-stations operate simultaneously on the successively moving film and shells to sequentially form the shells, fill the same and thereafter close the same.

In a preferred form of the invention the apparatus is constructed so that any single work-station as a whole is removable in relation to a common frame, and wherein the tools of any given work-station are themselves removable in relation to that work-station.

One group of stations includes a plurality of beams fitted with shackles for transferring shells. The beams include connecting means and driving and indexing means which cooperate with an actuating system which provides alternating, stepwise driving movements.

Full details of the present invention is given in the following description in which reference to the accompanying drawings showing an exemplary embodiment is made and which will give a clear understanding of how the invention can be carried into practice.

BRIEF DESCRIPTION OF DRAWINGS

In the drawings.

The diagrammatic showing obtained by juxtaposing

REFERENCE TO EARLIER APPLICATION

Figures 1, 3:
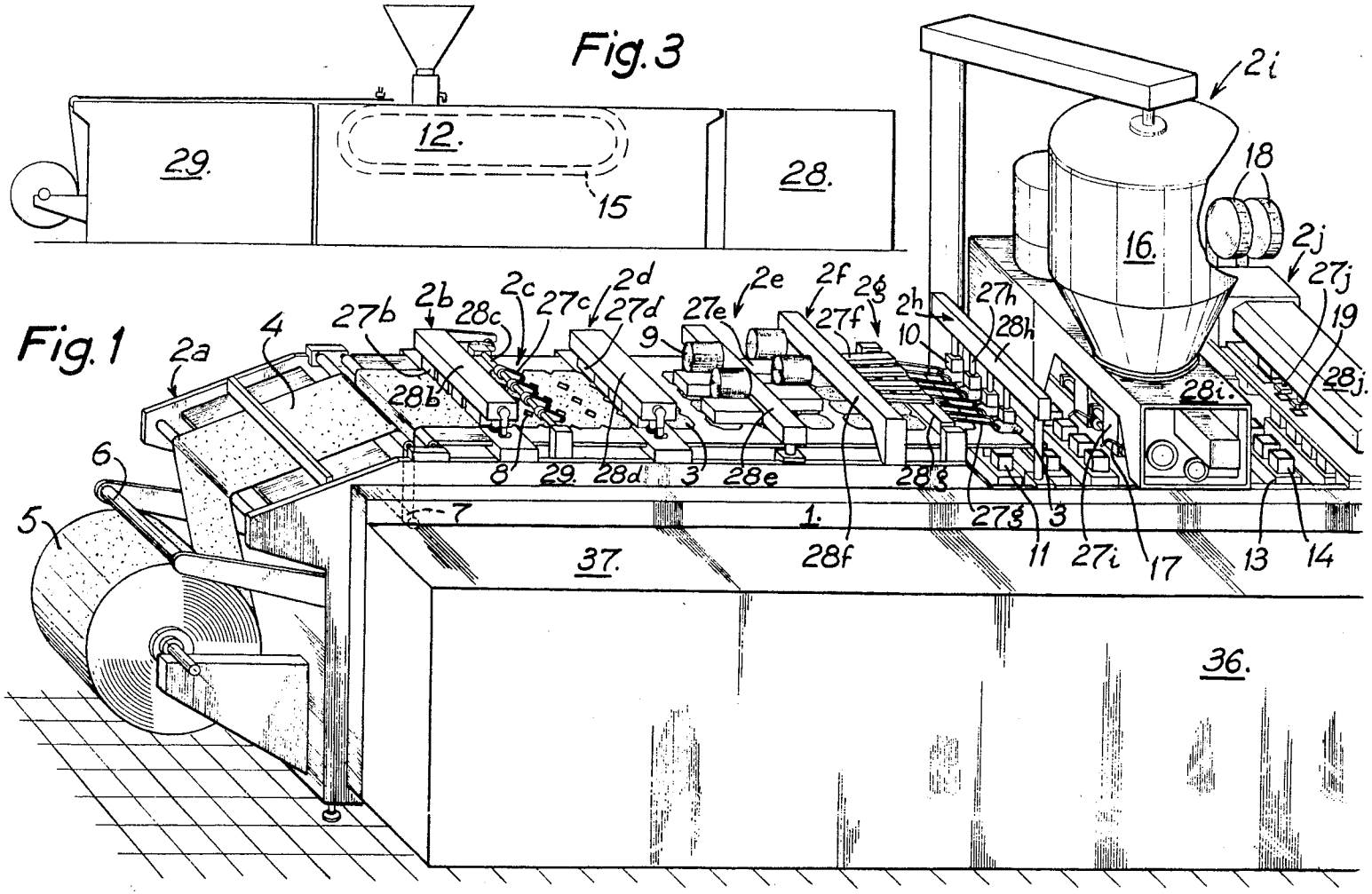
FIG. 1 and 2 is that of a machine according to this invention for packaging melted cheese in the form of portions in a printed wrapping consisting of a shell formed in one piece and having a tearaway strip and a cover.
FIGS. 3 and 4 are diagrammatic showing of the machine of FIGS. 1 and 2, equipped with a number of other work-positions.

Reference is made to the earlier filed application, Ser. No. 94,318 and its disclosure is incorporated herein as if more fully set forth.

DESCRIPTION OF INVENTION

The machine includes a frame 1 of relatively great length on which are mounted a number of work-positions or stations 2*a* through 2*p* having identical tools which are juxtaposed in line one behind the other in the longitudinal direction and which belong to three successive operations groups; to wit a shell-forming group 2*a* through 2*h*, a shell-filling, cover-positioning and portion-closing group 2*i* through 2*m*, and a portion-discharging, clustering and boxing group 2*n* through 2*p*.

The first group provides the initial formation of a plurality of square box-like blanks, having turned-down corners 3, out of a printed band of thin flexible aluminum foil 4 which is dispensed from a roll 5. The width of the bank 4 is equal to that of the number of juxtaposed blanks to be made. As seen the embodiment shown provides, for example, the formation of four shells. Accordingly, this group includes a work-station 2*a* for feeding the band, having a payout roll 6 and a jackey roll 7 for regulating the band speed whereby to correctly center the printing in relation to the band; a work-station 2*b* for cutting the corners of the blanks having stamping means 8; a work-station 2*c* for transferring the band; a work-station 2*d* for cutting the blanks 3 out of the band; a work-station 2*e* for positioning and welding the tearaway strip having an associated supply such as tearaway strip spools 9 and cutting and thermowelding means; a work-station 2*f* for changing the transverse pitch i.e. separating the blanks laterally; a work-station 2*g* for transferring the blanks; and, a work-station 2*h* for shaping the same in the form of shells 11, having pressing pistons 10 which nest these shells in the holding recesses 14 of the second operative group.

The second operative group is arranged after and downstream of the above-mentioned first group, but are located in an elevated position above transfer means 12 formed by a train of transverse bars or beams 13 each of which bear four box-like nests 14 defining the recesses into which the shells 11 are placed. Each beam 13 is disposed between two vertical endless chains 15. Suitable mechanism causes the chains 15 to index and advance stepwise in such manner that the beams 13 move along straight paths, stop at each work-station, and return to the head of the group after the product has been extracted. This second operative group includes work-station 2*i* for dosing and pouring the pasty product such as melted cheese, into the formed shells and have a pourer 16 including pouring spouts 17; a work-station 2*j* for moving up, cutting and positioning the covers, having at least one aluminum foil supply roll 18, and associated cutter 19; a work-station 2*k* for folding the edges of the shells having four levers 20 for forming the four folds; a work-station 2*l* for pressing and thermowelding the covers to the shells having vibrating heating-irons 21, and a work-station 2*m* for ejecting the portions from the nests 14 having pusher-pistons.

Figures 5, 6:
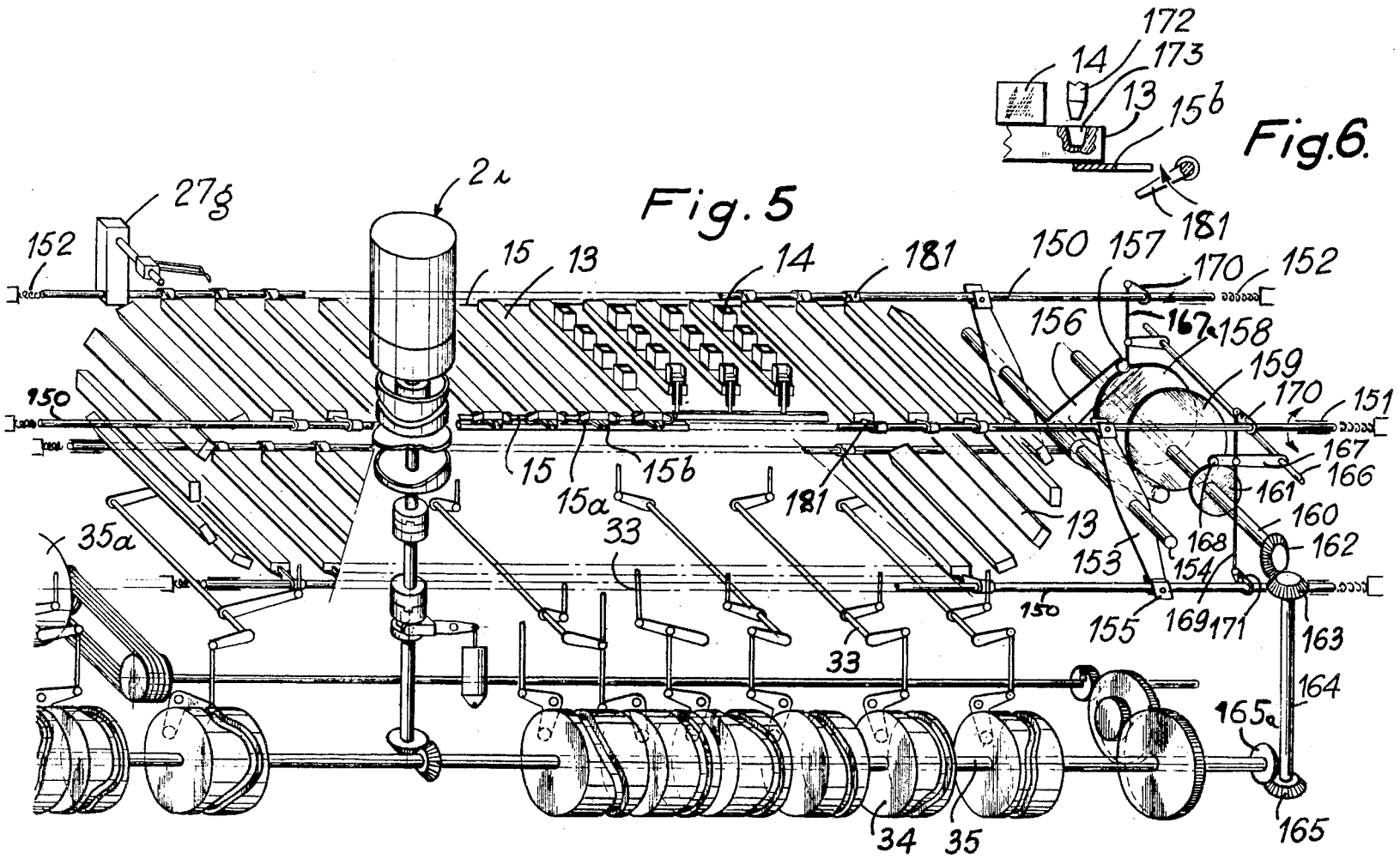
FIG. 5 illustrates schematically and partially in detail the arrangement of the indexing of the stamping bars for forming the shells to receive melted cheese.
FIG. 6 illustrates schematically the cooperative relationship of one of the fingers which drive and index a stamping bar.

As shown more particularly in FIGS. 5 and 6, the means 12 for transferring or driving the beams 13 comprises two parallel endless sprocket or link chains 15, each of which has relatively open links disposed vertically. The links of the chains being formed with rollers 15*a* which are supported on guide rails thus permitting the chains to move. Each end of the beam 13 is shackled to the chain 15 and is provided with a forked end 15*b* disposed in a lateral direction in opposed paired open links. The links themselves are relatively more open than the size of the forked ends. Thus the beams may shift axially, as if loosely shackled, with respect to the direction of movement of the chains.

Parallel to each edge of the rectilinear bottom and top courses of the chains 15, there is located an elongated action rod 150 which is supported in bearings 151 and which is capable of moving axially as well as rotatably oscillating in alternate movements. Shock absorbers such as springs 152 having opposing action, are arranged at the end of each rod 150. The top and bottom pair of action rods 150 located in the same vertical plane on each side of the beams 13 are connected by a pivoting oscillating arm 153 fixed on a pivot rod 154 having a transverse axis with respect to the machine. Suitable pivot attaching means 155 located at the extremity of arm 153 connects the arm to the rod 150 in a manner to assure accurate transmission of movement without any leg and eliminate any error which might otherwise occur when translating the circular movement of the attaching means 155 with respect to the rectilinear movement of corresponding rod 150.

A fork 156 is fixed about the center of pivot rod 154. The arms of the fork are adjustable angularly with respect to each other, as by being rotatably mounted about a single hub. The end of each arm of the fork is provided with a friction roller 157 which is disposed against the edge of a circular cam 158 and 149, respectively. The profile of the cams 158 and 159 are complementary and since the angular deviation between the two branches of the fork 156 is adjustable play may be eliminated in the transmission of movement between the cam shaft 160 and the rods 150. An additional cam 161 is mounted on cam shaft 160 which is connected by pinion gears 162 and 163 through a vertical shaft 164 and pinion gears 165 and 165*a* to the main drive shaft 35.

A shaft 166 is provided extending parallel to the shaft 160. The shaft 166 is provided with two arms 167 and 167*a*, each of which have friction rollers 168 which ride on the edge of the additional cam 161. Extending laterally in fixed position from the upper action rod 150 and from the lower action rod 150 are cranks 170 and 171 respectively. Each pair of cranks 170 and 171 are pivotally linked by a rod 169 which is also pivotally joined to the arms 167 and 167*a* respectively.

Consequently, in this manner, through the action of the main drive shaft 35, shaft 160 may be driven in a continuous rotary motion causing the two cams 158 and 159 to produce alternating longitudinal reciprocal movement of the action rods 150 via the fork 156 and arm 153. This movement is facilitated and regularized and dampened by the opposing spring bias of shock absorbers 152.

In addition, through the action of the cam 161, the arms 167 and 167*a* and the rods 169, all the action rods 150 are given an oscillating rotational movement about their axes. The action rods 150 are provided at regular intervals, corresponding to each of the ends of the beams 13 of the transferring means or assembly 12, with fingers 181 which cooperate with and temporarily engage the ford ends 15*b* thereof. Consequently, alternating longitudinal movement is transmitted from rods 150 to beams 13. At the end of an advance movement, fingers 181 move out of engagement with the fork ends 15*b* and the rods 150 freely return to the opposite positionwithout effecting position of beams 13 until the next advancing cycle.

It is in this manner that each of the beams 13 are given an irregular indexing movement through the individual action of the linear reciprocating and circularly oscillating action rods 150. The driving movement of the chain is not affected in any adverse fashion by the total inertia of the transferring means of of the assembly 12 with respect to beams 13; nor is there any articulation or vibration or uneven movement which can take place at the junctions between different links of the chains 15 such as would be the case should the driving of beams 13 result from a movement conferred thereon by the generally known types of chains employed with toothed wheels, such as the usual sprocket arrangements.

Consequently, it is possible to impart to the transfer beams 13 extremely fast movements with the assembly of the invention even though it embodies heavy transfer bars which have a large inertia, as well as irregular indexing. Movements of elevated frequency such as, for example, 100 stops and starts per minute are possible so that transfers between two working-stations, and the time required to stop under each of the tools is clearly possible. Thus, each operation may be carried out, from shell filling 2*h* through ejection station 2*m* in a sequential and yet simultaneous manner.

The ability to obtain increased speed or tempo of the irregular indexing movement is associated with the precise positioning of beams 13 under the different work-stations or work tools. This depends on the cooperation between fingers 181 and the fork addends 15*b* and between cams 158, 159 and the arms of fork 156. Since these are adjustable such association and cooperation can be easily obtained.

The same conditions exist in connection with the activity of the transporting means 12 or the return movement of the assembly, since in the rectilinear course of the return movement there exists the same cooperation of fork ends 15*b* with the stops 181 of the two lower rods 150. In this manner, errors caused by play in the chains do not affect the lengths of the courses except at the curved ends of the transport conveyor at which point of course there are no longer any tools.

In addition, at each station 2*h*, 2*j*, 2*k*, 2*e*, the tools which cooperate with the beams 13 having associated therewith one or two descending catches 172 projecting into openings 173 in beams 13 (FIG. 6). In this manner, the positioning after indexing of each working beam 13 is assured, under each station, until the return movement of action rods 150. The catches 172 and the openings 173 constitute temporary connections between beams 13 and each of the working-stations.

The last operative group, 2*n* to 2*p* is positioned further downstream and is arranged elevated above a flat continuously movable belt 26 on which the packaged portions are dropped. This group includes a discharge work-station 2*n* having pallet-carrying rods 22 mounted on endlessly moving chains 23; clustering work-stations 2*o* in which a first clustering is effected along two lines by means of convergining rails 24 and a second clustering into box-like arrangements of plural rows as well as lines by means of a transverse abutment member 25. The final work-station 2*p* comprising a portion-boxing work-station is separable from the other work-stations and is shown only on FIGS. 3 and 4.

Figures 2, 4:
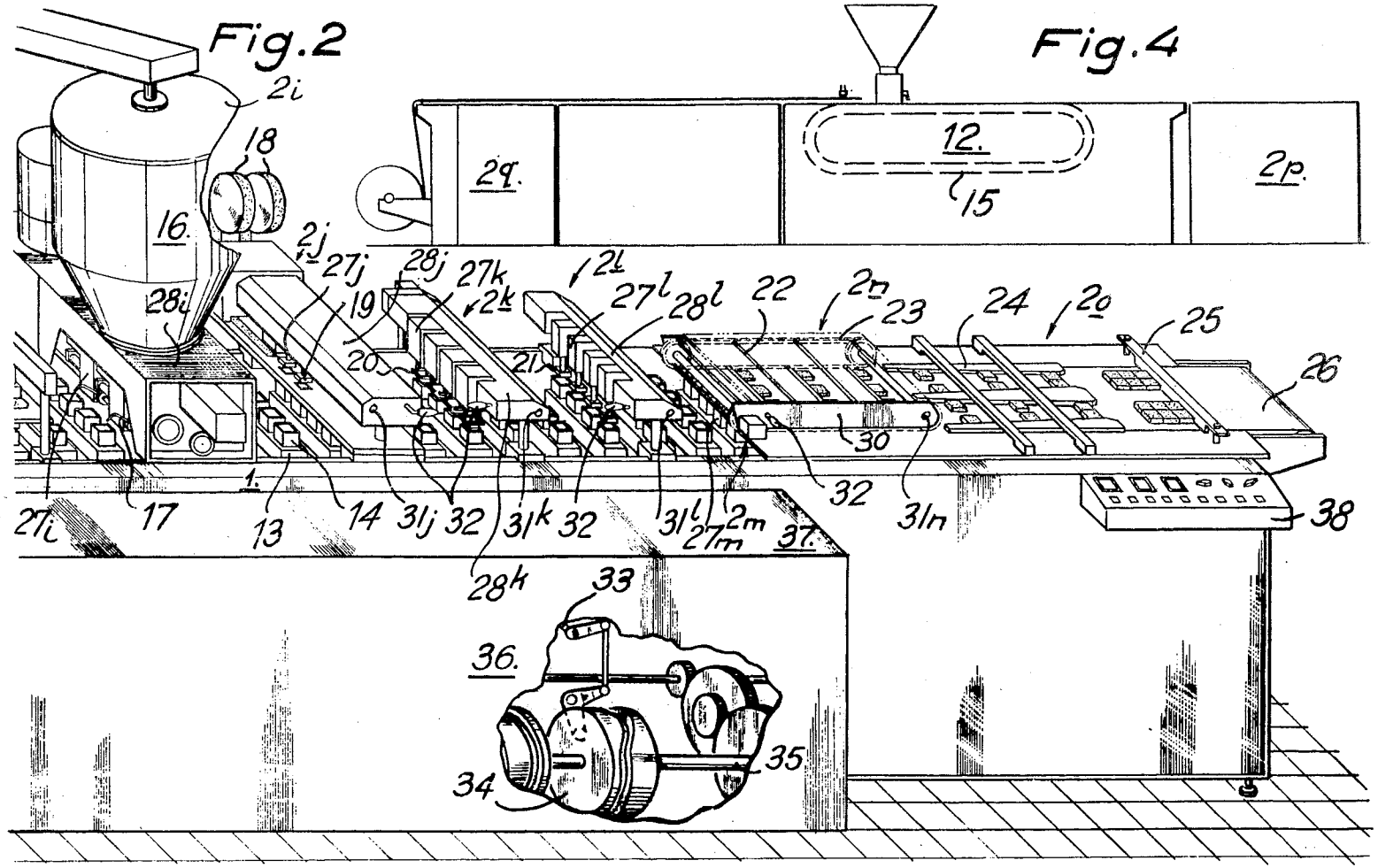

The first operative group of work-stations may include, in cases where the band is not printed, a labelling work-station 2*q*, disposed between work-stations 2*a* and 2*b* as seen in FIG. 4.

Work-stations 2*b* through 2*e* each include a plurality (in the example four) identical tools 27*b*, 27*c* (these include pressing rolls), 27*d* or 27*e* respectively adapted to the operation corresponding to the specific operative function to be obtained at that station. These tools are arranged along four equidistant parallel longitudinal lines. The spacing between each line is equal to the width of a blank formed from the foil 3 from which a shell is to be made. Work-station 2*f* has four tools 27*f* which increase the transverse spacing between the blanks by showing them apart. Work-stations 2*g* through 2*m* each likewise include four identical tools 27*g* through 27*m* respectively adapted to the operation corresponding to the specific operative function to be obtained at that work-station and are also arranged along four further extending equidistant parallel longitudinal lines. All the tools are arranged four by four in transverse rows and longitudinal lines. Tools 27*e* and 27*e* for supplying the tearaway strip at the affixing work-station 2*e;* the pouring device at work-station 2*a* which is bulkier transversely, then the other tools and the cover tool 27*j* at work-station 2*j* which has two transverse inlets (spools 18), are each arranged in twos along two parallel transverse rows although here too, it is to be clearly understood that operative elements such as the spouts, etc., are positioned to operate on the blank, shell etc., which are themselves positioned in the machine in the four transverse and longitudinal row and lines.

It will be seen from the foregoing that each of the conveyors for moving the foil 3, the sheels 11 and the filled containers are simultaneously movable, in stepwise or indexing fashion, and that each of the tools at each of the stations can be actuated simultaneously with each other, so that simultaneous formation of the blank and shell goes on in one part of the machine, together with the filling and closing of the container. By placing the tools and stations and arranging the materials in longitudinal lines (such as in rank) and along transverse rows (such as in file) a simultaneous operation of all tools may be effected so that sequentially the foil may be formed, filled and closed, all at the same time.

The machine can accordingly be used with a variable number of work-lines, the output being directly proportional to the number ofjuxtaposed parallel lines, and this with the same number of personnel, thereby reducing labor costs. Further, a saving is effected in the area of aluminum foil in the case of triangular portions since there is wastage only at the end of the band, thereby reducing the cost of starting materials and notably reducing the cost price. It is to be noted furthermore than the machine's output rate depends on the time required for the longest single operation and on the time of transfer from one row of nests to the other. Lastly production output can be increased by multiplying the number of lines without increasing the working rate.

In the case of work-positions 2*b* through 2*l*, moreover, the multiple and individual tools are removably positioned on transverse supporting bridges 28*b* through 28*l* each of which comprises a transverse main beam and two lateral uprights fixed to the frame. The beams are themselves removably mounted in relation to the uprights through the medium, say, of bolts and slideways, with the exception of bridges 28*a* and 28*g* belonging to the two transfer work-positions, which are connected to an appropriate stepwise longitudinal travel motion mechanism.

Each work-position can accordingly be removed for cleaning purposes, for example, or for replacement by a different work-position in cases where a packaging calling for different operations and hence different tools is required; similarly, a single tool may be removed from a work-position for cleaning or for replacement in the event of unsatisfactory operation. As a result, machine stoppages are reduced and individual work-position adjustments facilitated, thereby increasing profitability.

The set of shell-forming work-positions 2*a* through 2*h* forms a block mounted on a common frame 29 which is separable from the subsequent work-positions (filling and closing), thus enabling it to be replaced by a similar block adapted to packaging with a different type of folding and a different type of portion (e.g. a triangular or round portion) or with shells formed in two parts for example (a girdle and an endportion). Similarly, the set of work-positions 2*n* and 2*o* forms a block which is essentially variable according to the product and to the way the same is clustered and boxed (which depends on the shape of the portions). It is therefore relatively easy to modify the number of unit machine operations by providing, upstream of the second set of work-positions, work-positions for producing different shells and by providing, downstream of this set, variants in the clustering pattern.

In addition, the beams of bridges 28*j*, 28*k*, and 28*l* and the frame 30 of work-position 2*n* are pivotally mounted about transverse axes 31*j*, 31*k*,31*l* and 31*n* and can therefore be raised by means of grips 32, thus providing access to the nest-carrying rods for cleaning purposes, for correcting a faulty fold, or for making adjustments.

Provided between the various successive work-positions are blank spaces for checking operation of the several work-positions, but it goes without saying that the latter could be arranged contiguously in order to form a continuous tunnel.

The three sets of work-positions are operated in synchronism by means of a single master control, through the agency of a set of tool-actuating rods 33 which are actuated by cams 34 mounted on a single longitudinal control shaft 35 arranged along the length of the machine inside an oil-bath type cam-box 26 provided with a cover 37, the entire system being controlled from a control console 38.

Various changes, modifications and other advantages will be obvious to those skilled in this art. Accordingly, the disclosure is intended to be illustrative only and not limiting of the scope of the invention.

What is claimed:

1. A machine for packaging pasty materials such as cheese in individual packages comprising an elongated continuous conveyor system, means for feeding a substantially endless thin flexible film to an end of said conveyor system, a plurality of work stations spaced successively along said conveyor system, each of said work stations having a plurality of identical tools for performing a single operation on said film, the tools of each station being longitudinally aligned with those of the other stations to provide a plurality of parallel processing lines, said work stations being divided into at least two groups arranged along said conveyor system, the first group functioning to successively cut the leading end of said film and shape said film into individual flexible shells arranged in successive ranks with respect to said conveyor system and a second group functioning to simultaneously fill said flexible shells in each successive rank and to close said filled flexible shells to form the packages, said conveyor system including conveyor means associated with said second group for carrying said flexible shells between the successive work stations comprising a plurality of spaced transverse transfer bars, each having receiving supports for each shell in each rank, said supports being aligned in rank and means for synchronously indexing said conveyor through said successive work stations and operating each of said tools simultaneously at each of said work stations on completion of each index, said conveyor system including a common driving means connected to the ends of said bars and actuating means which reciprocably indexes said transfer bars with respect to each of the work stations along said conveyor means.

2. The machine according to claim 1, wherein said actuating means comprises at least one fork located at each end of said transfer bars, at least one pair of action bars provided with fingers engageable in said fork, driving means for imparting reciprocable axi al movement to said action bars and means for reciprocably oscillate to said action bars about their longitudinal axis.

3. The machine according to claim 2, including spring means associated with the action bars for biasing said bars in both directions of reciprocation.

4. The machine according to claim 2, wherein the means for imparting axial movement to said action bars comprises a pair of cams having complementary profiles and two adjustable cam followers, said followers being disposed on an articulating assembly on said actuating bars.

5. The machine according to claim 2 in which each transfer bar and work station comprises a common lowering means mechanically operative during the return movement of the action bars and at the same time as the activation of said work stations.

6. The machine according to claim 1, wherein said common drive means is connected to said means for feeding said endless film and each of said tools for synchronously driving said conveyor and for simultaneously operating each of said tools at each of said work stations to form a continuous progression of ranks of shells, to fill the same and close the filled shells sequentially along said conveyor.

7. The machine as claimed in claim 6, including means for mounting the tools of each work station along a single transverse line relatively to said machine.

8. The machine as claimed in claim 6, including means for mounting the tools of each station along two transverse lines relatively to said machine.

9. The machine as claimed in claim 6, including a common frame and means for removably mounting any single work station as a whole in relation to said common frame.

10. The machine as claimed in claim 6, wherein a given work station as a whole is mounted to form a bridge in relation to said conveyor on a common frame.

11. The machine as claimed in claim 6, wherein certain of said work stations are each pivotally mounted about an axis extending transversely of said machine.

12. The machine as claimed in claim 6, including a single master control means and a single camshaft arranged along the length of said machine actuating each of said tools simultaneously.

* * * * *